United States Patent [19]

Schröder

[11] 3,985,085

[45] Oct. 12, 1976

[54] COMBINED INCINERATOR FOR OIL SLUDGE AND SOLID WASTES

[75] Inventor: Henrik Anton Schröder, Fredrikstad, Norway

[73] Assignee: A/S Fredriksstad mek. Verksted, Norway

[22] Filed: May 27, 1975

[21] Appl. No.: 581,182

[30] Foreign Application Priority Data

May 30, 1974 Norway ..... 1966/74

[52] U.S. Cl. ..... 110/8 C; 110/7 B; 110/10

[51] Int. Cl.[2] ..... F23G 5/12

[58] Field of Search ..... 110/7 R, 7 B, 8 R, 8 C, 110/8 A, 10, 18 R, 18 C

[56] References Cited

UNITED STATES PATENTS

| | | | |
|---|---|---|---|
| 3,269,340 | 8/1966 | Crawford et al. | 110/8 |
| 3,559,597 | 2/1971 | Heiny | 110/10 |
| 3,585,946 | 6/1971 | Dahlund | 110/8 |
| 3,822,653 | 7/1974 | Ghelfi | 110/7 |

*Primary Examiner*—Kenneth W. Sprague
*Attorney, Agent, or Firm*—Ladas, Parry, Von Gehr, Goldsmith & Deschamps

[57] ABSTRACT

A combined incinerator for fluid waste, such as oil sludge, and solid waste, such as garbage and refuse. The combustion chamber is — in one vertical cross-sectional plane — U-shaped with opposite upright legs, and in one other vertical cross-sectional plane, normal to the first one, rectangular with substantially vertical opposite side walls. A ceiling is closing the combustion chamber. The burner for fluid waste and a fan means for introduction of combustion air are located in the ceiling adjacent the top of one leg in the U, the exhaust gases are discharged through the ceiling adjacent the top of the other U while in the center portion of ceiling is provided a separate access opening for letting in solid wastes.

7 Claims, 3 Drawing Figures

COMBINED INCINERATOR FOR OIL SLUDGE AND SOLID WASTES

Figure 1:
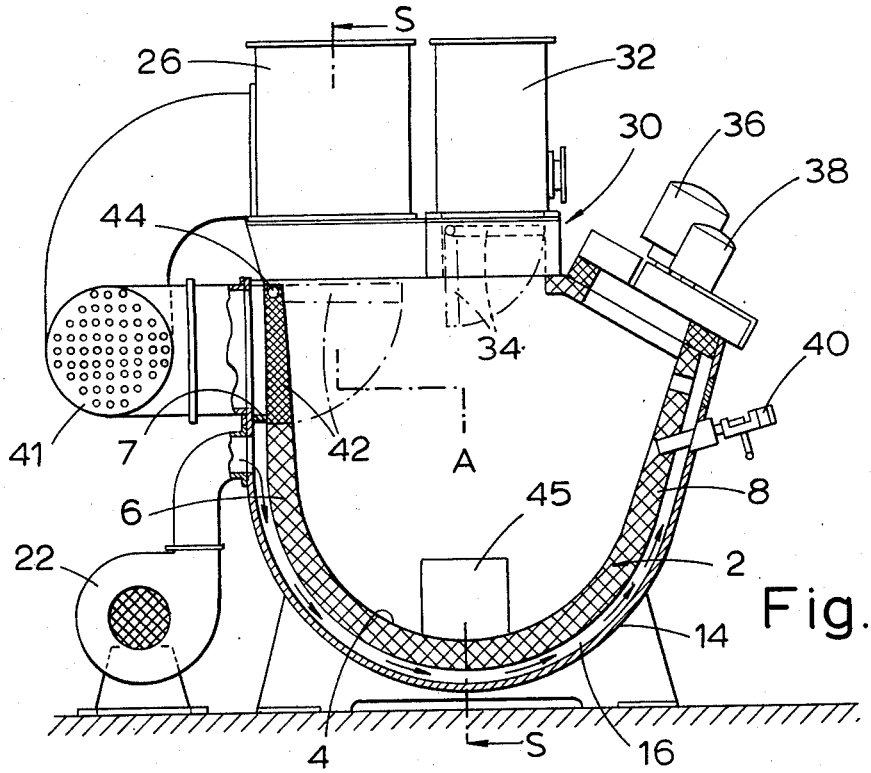

The present invention relates to a combined incinerator for burning oil sludge and the like as well as solid wastes, such as refuse, garbage etc. The incinerator in accordance with the invention is especially developed to be used on ships, but may also be adapted to be used ashore.

The main object of the invention has been to provide a new type of incinerator which meets the demand to a compact and rugged construction and which is simple to operate, simultaneously as it is an aim to obtain effective combustion in a way which is not detrimental to the environments.

There is known several incinerator designs which partly fulfil at least some of the objects mentioned above.

A short-coming with known incinerators is that they are not capable of burning both fluid waste and solid wastes, such as garbage. A special object of the invention is thus to provide an incinerator which is capable of burning fluid waste, such as oil sludge, and solid wastes, such as refuse and garbage, either separately or in one operation.

The incinerator in accordance with the invention is of the kind comprising a combustion chamber, means for introduction of oil sludge or the like, and for solid wastes, and furthermore means for removal of combustion products, a main burner, a burner for combustion of fuel oil and means for forced supply of combustion air. Finally, the incinerator is provided with means for circulation of cooling air on the outside of the combustion chamber.

The incinerator in accordance with the invention is generally characterised in that said combustion chamber - in one vertical cross-sectional plane — is U-shaped with opposite upright legs, and in one other vertical cross-sectional plane, normal to the first one, represents a rectangular form with substantially vertical opposite side walls, a roofing closing the combustion chamber, and in that said main burner for fluid waste and the means for introduction of combustion air, are located in the roofing adjacent the top of one leg in the U, and in that the exhaust gases are discharged through the roofing adjacent the top of the other U and in that said roofing is provided with a separate access opening in its center-portion between said legs for letting in said solid wastes.

In an incinerator in accordance with the invention the solid waste will during the combustion rest at the bottom portion of the thus pot-shaped combustion chamber, while the combustion air in general is flowing through the chamber in a U-shaped stream, namely preliminary downwardly along the one chamber wall, partly or entirely along or through the solid waste — is any — for thereafter to flow upwardly along the opposite wall for finally to leave the chamber at the top thereof.

A significant feature of the incinerator is that it can alternatively burn either fluid waste or solid waste or both types of waste simultaneously. The U-shaped flow pattern of the combustion air together with the fluid waste which closely follows the U-shaped high temperature combustion chamber wall results in a comparatively long flow path and thus effective burning. Easily burnt fractions of the fluid waste will burn completely and the combustion gases will go directly up into the chimney, while heavier fractions of the fluid waste may in part fall down and temporarily deposit at the bottom part of the pot-shaped combustion chamber. Such heavier fluid waste will, however, be effectively heated and fired by the by-passing burning fluid waste and therefore be burnt off completely.

When burning solid waste only one may use combustion air fed downwardly from the main burner. Combustion air may additionally or alternatively be fed into the combustion chambers at the bottom part of same through a separate access. Part of the cooling air flowing through the passages outside the chamber walls may for such purpose be branched off and directed into the combustion chamber.

The incinerator in accordance with the invention presents also other new features. Thus, due to its compact construction and comparatively high operating temperature it is provided with a special flow passage system for a cooling air for counter flow cooling of the combustion chamber. The cooling air is thereafter mixed with the exhaust gases in order to reduce the temperature of same. Furthermore, an incinerator in accordance with the invention is well adapted to be combined with a heat exchanger which may serve as a steam generator, hot water supply, etc.

Figure 2:
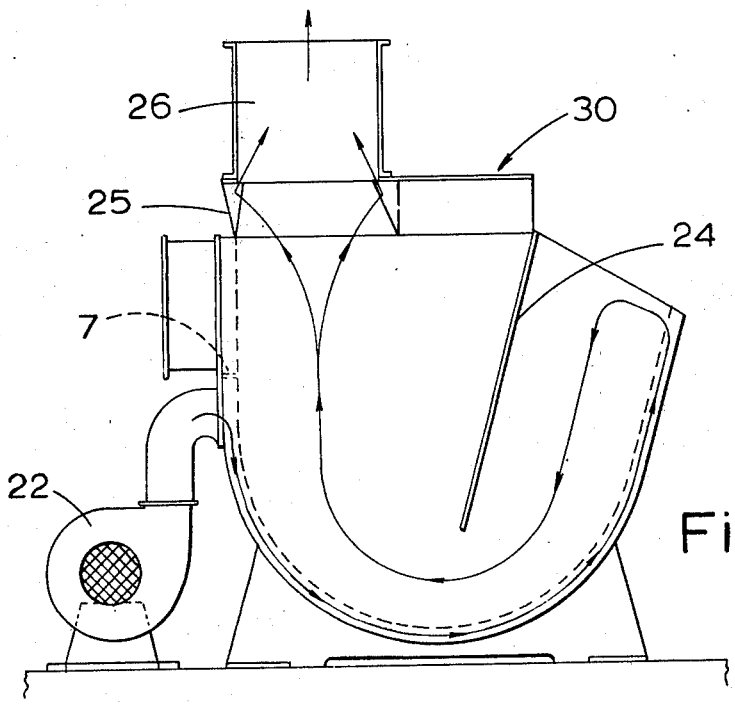
Figure 3:
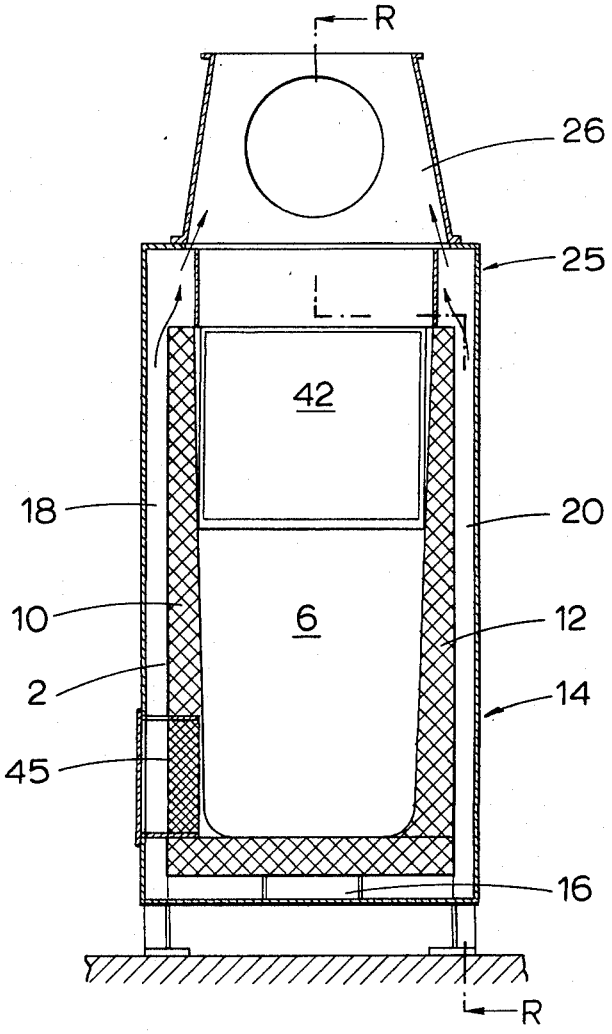

An embodiment of an incinerator in accordance with the invention shall be described with reference to the accompanying drawings, wherein:

FIG. 1 is showing a vertical cross-section through a preferred embodiment of an incinerator according to the invention, FIG. 2 is showing a schematic section along the plane R—R in FIG. 3 and showing the arrangement of the channels for the cooling air, and FIG. 3 is showing an elevational section along the plane S—S in FIG. 1 of an incinerator in accordance with the invention.

In the Figures the capital letter A designates the combustion chamber of the incinerator which in one vertical section (FIG. 2) is defined by a U-shaped refractory brick or chamotte wall designated with the number 2 including a curved or pot-shaped bottom part 4 and two opposing, upwardly directed lateral walls 6 and 8, respectively, and in another vertical section (FIG. 3) has two opposed vertical end walls 10 and 12. The refractory brick walls 2 of the combustion chamber are encompassed by an outer cooling mantle 14 for cooling air and having a passage 16 along the U-shaped bottom part as well as channels 18 and 20 along the opposing vertical end walls. The cooling air is supplied from a fan unit 22 and is as best illustrated in FIG. 2 conveyed such that the air initially is introduced into the cooling mantle below a cross-going separating wall 7, and is then flowing in direction downwards below the curved bottom part of the chamber such that this hotest part of the chamber is cooled firstly, and thereafter the air is flowing upwardly along the opposite vertical wall and thereafter back or in a return flow through the opposite vertical end walls 10 and 12 down around downwardly pointing baffle plates 24 and then finally up into a base section 25 in the exhaust channel 26, wherein the cooling air mixes with the combustion gases or exhaust from the incinerator and is flowing up into a chimney (not shown).

The incinerator is provided with a hinged cover 30 including a combined hopper and storage bin 32 for solid refuse to be burnt and as mentioned including a tiltable cover 34 to carry out periodic down throwing of solid refuse such that same comes to rest at the lowest part of the combustion chamber.

One of the upwardly directed legs of the U-shaped combustion chamber, more specifically the leg opposite the side whereto is introduced the cooling air is provided a burner 36 for fluid waste such as oil sludge or slurry. This burner is combined with a fan 38 which is injecting, in the shape of a downwardly directed air stream, all air which is necessary for the combustion, that is also combustion air for solid refuse to be burnt. The combustion air stream is directed downwardly along the side wall 8. At a suitable level and in one of the side walls of the combustion chamber, preferably below the main burner 36 such as shown in FIG. 1, is furthermore located an auxiliary burner 40 for diesel oil or light fuel oil. This burner should burn continuously in order to fire the fluid and/or solid waste to be burnt, to maintain the combustion and also to maintain a sufficiently high temperature in the combustion chamber in order to ensure complete combustion of all wastes to be burnt.

Straight above the curved combustion chamber located on the side opposite the burner 36, is located the channel or chimney 26 for combustion or exhaust gases. In the shown embodiment of the invention the incinerator is furthermore provided with a separate heat exchanger 41 which possibly also can serve as steam generator. The chimney is provided with a disc 42 which is turnable on a shaft 44 between horizontal positions, as shown in stitched lines, wherein all exhaust gases are forced through the heat exchanger, and the shown vertical position wherein all exhaust gases are led directly up into the chimney. Intermediate positions are naturally optional and also frequently used.

In one of the vertical end walls of the combustion chamber is provided a discharge opening 45 for ash and other remains from the waste. Ash and remains are removed with a scraper or other mechanical implements. Outside the incinerator may be positioned a hopper or possibly other conveying means for removal of ash and remains. At combustion of oil sludge no ash will appear but the exhaust gases may contain corrosive constituents and such exhaust gases should not be passed off immediately neither be led through the heat exchanger.

The shape of the combustion chamber and the other features significant for the incinerator result in a very effective combustion of solid as well as of fluid wastes simultaneously as the incinerator may serve as auxiliary steam generator, *f.* inst. for producing hot water and/or steam. A significant feature of the incinerator in accordance with the invention is its very compact design.

I claim:

1. Combined incinerator for fluid waste, such as oil sludge, and solid waste, such as garbage and refuse, comprising a combustion chamber provided with access means for introducing said wastes, means for discharge of combustion products, such as ash and exhaust gas, means for introduction of combustion air, a main burner for fluid wastes, and at least one auxiliary burner for fuel oil and means for forced circulation of the combustion air, and means for circulation of cooling air on the outside of the combustion chamber, characterized in that said combustion chamber - in one vertical cross-sectional plane — is U-shaped with opposite upright legs, and in one other vertical cross-sectional plane, normal to the first one, represents a rectangular form with substantially vertical opposite side walls, a roofing closing the combustion chamber, and in that said main burner for fluid waste and the means for introduction of combustion air, are located in the roofing adjacent the top of one leg in the U, and in that the exhaust gases are discharged through the roofing adjacent the top of the other U and in that said roofing is provided with a separate access opening (34) in its center-portion between said legs for letting in said solid wastes.

2. Incinerator in accordance with claim 1, characterized in that separate cooling passages are arranged for the U-shaped section of the combustion chamber and the two opposite vertical wall sections of the combustion chamber, respectively, said passages joining each other at the top of the combustion chamber in the vicinity of the main burner.

3. Incinerator in accordance with claim 2, characterized in that each of the cooling passages in the opposite vertical wall sections of the combustion chamber, is provided with a centrally located, downwardly directed baffle plate operable to direct the cooling air along the lowermost part of the walls.

4. Incinerator in accordance with claim 1, characterized in that the one U-shaped leg of the combustion chamber on the side with the main burner and introduction of combustion air, is sloping slightly outwards.

5. Incinerator in accordance with claim 4, characterized in that in the outwardly sloping combustion chamber wall is located said auxiliary burner (40) serving as firing and support burner for the main burner (36).

6. Incinerator in accordance with claim 5, characterized in that the combustion air and fluid waste is blown into the combustion chamber at the main burner in direction downwardly substantially parallely with the adjacent wall of the combustion chamber constituting one of the legs in the U.

7. Incinerator in accordance with claim 5, characterized in that the refractory bricking or chamotte is discontinued at the top of the walls of the combustion chamber, the roofing of the combustion chamber being without refractory bricking or chamotte.

* * * * *